US006760059B2

(12) United States Patent
Ham

(10) Patent No.: US 6,760,059 B2
(45) Date of Patent: Jul. 6, 2004

(54) METHOD AND APPARATUS FOR DRIVING LIQUID CRYSTAL DISPLAY

(75) Inventor: Yong Sung Ham, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 225 days.

(21) Appl. No.: 10/001,788

(22) Filed: Dec. 5, 2001

(65) Prior Publication Data

US 2003/0095090 A1 May 22, 2003

(30) Foreign Application Priority Data

Sep. 12, 2001 (KR) ..... P2001-56235

(51) Int. Cl.[7] ..... G09G 3/36
(52) U.S. Cl. ..... 348/87; 345/213; 345/718
(58) Field of Search ..... 345/87, 211, 212, 345/213, 204, 717, 718; 348/511, 576, 554, 588, 476, 473

(56) References Cited

U.S. PATENT DOCUMENTS 5,479,189 A * 12/1995 Chesavage et al. ..... 345/603
5,495,265 A 2/1996 Hartman et al.
5,815,135 A * 9/1998 Yui et al. ..... 345/97
5,986,636 A * 11/1999 Wu ..... 345/691
6,046,737 A * 4/2000 Nakamura ..... 345/213
6,078,317 A * 6/2000 Sawada ..... 345/204
6,348,931 B1 * 2/2002 Suga et al. ..... 345/699

FOREIGN PATENT DOCUMENTS

JP 04116686 * 4/1992
WO WO 99/05567 2/1999

* cited by examiner

*Primary Examiner*—Dennis-Doon Chow
(74) *Attorney, Agent, or Firm*—Morgan Lewis & Bockius LLP

(57) ABSTRACT

The present invention discloses a method and apparatus for driving a liquid crystal display device that improves a picture quality. More specifically, in the method and apparatus, a driving frequency is detected to select one of the modulated data outputted from a plurality of look-up tables in accordance with the detected driving frequency, thereby modulating source data.

9 Claims, 5 Drawing Sheets

METHOD AND APPARATUS FOR DRIVING LIQUID CRYSTAL DISPLAY

This application claims the benefit of Korean Application No. P2001-56235 filed on Sep. 12, 2001, which is hereby incorporated by reference.

BACKGROUND OF THE INVENTION

1. Field of the Invention

The present invention relates to a liquid crystal display, and more particularly, to a method and apparatus of driving a liquid crystal display. Although the present invention is suitable for a wide scope of applications, it is particularly suitable for improving a picture quality.

2. Discussion of the Related Art

Generally, a liquid crystal display (LCD) controls a light transmittance of each liquid crystal cell in accordance with a video signal, thereby displaying a picture. An active matrix LCD including a switching device for each liquid crystal cell is suitable for displaying a moving picture. The active matrix LCD uses a thin film transistor (TFT) as a switching device.

The LCD has a disadvantage in that it has a slow response time due to inherent characteristics of a liquid crystal, such as a viscosity and an elasticity, etc. Such characteristics can be explained by using the following equations (1) and (2):

$$\pi_r \propto \gamma d^2/\Delta\epsilon |V_a^2 - V_F^2| \quad (1)$$

where $\pi_r$ represents a rising time when a voltage is applied to a liquid crystal, $V_a$ is an applied voltage, $V_F$ represents a Freederick transition voltage at which liquid crystal molecules begin to perform an inclined motion, d is a cell gap of liquid crystal cells, and $\gamma$ represents a rotational viscosity of the liquid crystal molecules.

$$\pi_f \propto \gamma d^2/K \quad (2)$$

where $\pi_f$ represents a falling time at which a liquid crystal is returned into the initial position by an elastic restoring force after a voltage applied to the liquid crystal was turned off, and K is an inherent elastic constant of a liquid crystal.

A twisted nematic (TN) mode liquid crystal has a different response time due to physical characteristics of the liquid crystal and a cell gap, etc. Typically, the TN mode liquid crystal has a rising time of 20 to 80 ms and a falling time of 20 to 30 ms. Since such a liquid crystal has a response time longer than one frame interval (i.e., 16.67 ms in the case of NTSC system) of a moving picture, a voltage charged in the liquid crystal cell is progressed into the next frame prior to arriving at a target voltage. Thus, due to a motion-blurring phenomenon, a moving picture is blurred out on the screen.

Referring to FIG. 1, the conventional LCD cannot express desired color and brightness. Upon implementation of a moving picture, a display brightness BL fails to arrive at a target brightness corresponding to a change of the video data VD from one level to another level due to its slow response time. Accordingly, a motion-blurring phenomenon appears from the moving picture and a display quality is deteriorated in the LCD due to a reduction in a contrast ratio.

In order to overcome such a slow response time of the LCD, U.S. Pat. No. 5,495,265 and PCT International Publication No. WO99/05567 have suggested to modulate data in accordance with a difference in the data using a look-up table (hereinafter referred to as high-speed driving scheme). This high-speed driving scheme allows data to be modulated by a principle as shown in FIG. 2.

Referring to FIG. 2, a conventional high-speed driving scheme modulates input data VD and applies the modulated data MVD to the liquid crystal cell, thereby obtaining a desired brightness MBL. In the high-speed driving scheme, $|V_a^2 - V_F^2|$ is increased from the above equation (1) on the basis of a difference of the data so that a desired brightness can be obtained in response to a brightness value of the input data within one frame interval, thereby rapidly reducing a response time of the liquid crystal. Accordingly, the LCD employing such a high-speed driving scheme compensates for a slow response time of the liquid crystal by modulating a data value in order to alleviate a motion-blurring phenomenon in a moving picture, thereby displaying a picture at desired color and brightness.

In other words, the high-speed driving scheme compares most significant bits MSB of the previous frame Fn−1 with those of the current frame Fn. If there is a change in the most significant bits, the corresponding modulated data Mdata are selected from the look-up table to modulate the data as shown in FIG. 3. The high-speed driving scheme modulates only several most significant bits to reduce a memory size upon implementation of hardware equipment. A high-speed driving apparatus implemented in this manner is as shown in FIG. 4.

Referring to FIG. 4, a conventional high-speed driving apparatus includes a frame memory 43 connected to a most significant bit bus line 42 and a look-up table 44 commonly connected to the most significant bit bus line 32 and an output terminal of the frame memory 43.

The frame memory 43 stores most significant bit data MSB during one frame interval and supplies the stored data to the look-up table 44. Herein, the most significant bit data MSB may be the most significant 4 bits of the 8-bit source data RGB.

The look-up table 44 compares most significant bits MSB of a current frame Fn inputted from the most significant bit line 42 with those of the previous frame Fn−1 inputted from the frame memory 43 as shown in Table 1 or Table 2, and selects the corresponding modulated data Mdata. The modulated data Mdata are added to least significant bits LSB from a least significant bit bus line 41.

TABLE 1

| | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 2 | 3 | 4 | 5 | 6 | 7 | 9 | 10 | 12 | 13 | 14 | 15 | 15 | 15 | 15 |
| 1 | 0 | 1 | 3 | 4 | 5 | 6 | 7 | 8 | 10 | 12 | 13 | 14 | 15 | 15 | 15 | 15 |
| 2 | 0 | 0 | 2 | 4 | 5 | 6 | 7 | 9 | 10 | 12 | 13 | 14 | 15 | 15 | 15 | 15 |
| 3 | 0 | 0 | 1 | 3 | 5 | 6 | 7 | 8 | 10 | 11 | 13 | 14 | 15 | 15 | 15 | 15 |
| 4 | 0 | 0 | 1 | 2 | 4 | 6 | 7 | 8 | 9 | 11 | 12 | 13 | 14 | 15 | 15 | 15 |
| 5 | 0 | 0 | 1 | 2 | 3 | 5 | 7 | 8 | 9 | 11 | 12 | 13 | 14 | 15 | 15 | 15 |
| 6 | 0 | 0 | 1 | 2 | 3 | 4 | 6 | 8 | 9 | 10 | 12 | 13 | 14 | 15 | 15 | 15 |
| 7 | 0 | 0 | 1 | 2 | 3 | 4 | 5 | 7 | 9 | 10 | 11 | 13 | 14 | 15 | 15 | 15 |
| 8 | 0 | 0 | 1 | 2 | 3 | 4 | 5 | 6 | 8 | 10 | 11 | 12 | 13 | 15 | 15 | 15 |
| 9 | 0 | 0 | 1 | 2 | 3 | 4 | 5 | 6 | 7 | 9 | 11 | 12 | 13 | 14 | 15 | 15 |

TABLE 1-continued

| | | | | | | | | | | | | | | | | |
|---|---|---|---|---|---|---|---|---|---|---|---|---|---|---|---|---|
| 10 | 0 | 0 | 1 | 2 | 3 | 4 | 5 | 6 | 7 | 8 | 13 | 12 | 13 | 14 | 15 | 15 |
| 11 | 0 | 0 | 1 | 2 | 3 | 4 | 5 | 6 | 7 | 8 | 9 | 11 | 12 | 14 | 15 | 15 |
| 12 | 0 | 0 | 1 | 2 | 3 | 4 | 5 | 6 | 7 | 8 | 9 | 10 | 12 | 14 | 15 | 15 |
| 13 | 0 | 0 | 1 | 2 | 3 | 3 | 4 | 5 | 6 | 7 | 8 | 10 | 11 | 13 | 15 | 15 |
| 14 | 0 | 0 | 1 | 2 | 3 | 3 | 4 | 5 | 6 | 7 | 8 | 9 | 11 | 12 | 14 | 15 |
| 15 | 0 | 0 | 0 | 1 | 2 | 3 | 3 | 4 | 5 | 6 | 7 | 8 | 9 | 11 | 13 | 15 |

TABLE 2

| | 0 | 16 | 32 | 48 | 64 | 80 | 96 | 112 | 128 | 144 | 160 | 176 | 192 | 208 | 224 | 240 |
|---|---|---|---|---|---|---|---|---|---|---|---|---|---|---|---|---|
| 0 | 0 | 32 | 48 | 64 | 80 | 96 | 112 | 144 | 160 | 192 | 208 | 224 | 240 | 240 | 240 | 240 |
| 16 | 0 | 16 | 48 | 64 | 80 | 96 | 112 | 128 | 160 | 192 | 208 | 224 | 240 | 240 | 240 | 240 |
| 32 | 0 | 0 | 32 | 64 | 80 | 96 | 112 | 128 | 160 | 192 | 208 | 224 | 240 | 240 | 240 | 240 |
| 48 | 0 | 0 | 16 | 48 | 80 | 96 | 112 | 128 | 160 | 176 | 208 | 224 | 240 | 240 | 240 | 240 |
| 64 | 0 | 0 | 16 | 48 | 64 | 96 | 112 | 128 | 144 | 176 | 192 | 208 | 224 | 240 | 240 | 240 |
| 80 | 0 | 0 | 16 | 32 | 48 | 80 | 112 | 128 | 144 | 176 | 192 | 208 | 224 | 240 | 240 | 240 |
| 96 | 0 | 0 | 16 | 32 | 48 | 64 | 96 | 128 | 144 | 160 | 192 | 208 | 224 | 240 | 240 | 240 |
| 112 | 0 | 0 | 16 | 32 | 48 | 64 | 80 | 112 | 144 | 160 | 176 | 208 | 224 | 240 | 240 | 240 |
| 128 | 0 | 0 | 16 | 32 | 48 | 64 | 80 | 96 | 128 | 160 | 176 | 192 | 224 | 240 | 240 | 240 |
| 144 | 0 | 0 | 16 | 32 | 48 | 64 | 80 | 96 | 112 | 144 | 176 | 192 | 208 | 224 | 240 | 240 |
| 160 | 0 | 0 | 16 | 32 | 48 | 64 | 80 | 96 | 112 | 128 | 160 | 192 | 208 | 224 | 240 | 240 |
| 176 | 0 | 0 | 16 | 32 | 48 | 64 | 80 | 96 | 112 | 128 | 144 | 176 | 208 | 224 | 240 | 240 |
| 192 | 0 | 0 | 16 | 32 | 48 | 64 | 80 | 96 | 112 | 128 | 144 | 160 | 192 | 224 | 240 | 240 |
| 208 | 0 | 0 | 16 | 32 | 48 | 48 | 64 | 80 | 96 | 112 | 128 | 160 | 176 | 208 | 240 | 240 |
| 224 | 0 | 0 | 16 | 32 | 48 | 48 | 64 | 80 | 96 | 112 | 128 | 144 | 176 | 192 | 224 | 240 |
| 240 | 0 | 0 | 0 | 16 | 32 | 48 | 48 | 64 | 80 | 96 | 112 | 128 | 144 | 176 | 208 | 240 |

In the above tables, a left column is for a data voltage VDn−1 of the previous frame Fn−1 while an uppermost row is for a data voltage VDn of the current frame Fn. Table 1 is a look-up table information in which the most significant bits (i.e., $2^0$, $2^1$, $2^2$ and $2^3$) are expressed by the decimal number format. Table 2 is a look-up table information in which weighting values (i.e., $2^4$ $2^5$, $2^6$ and $2^7$) of the most significant 4 bits are applied to 8-bit data.

However, the conventional high-speed driving scheme is problematic. Since it has been studied on the assumption that a driving frequency of the data is fixed like a television, the conventional scheme is difficult to be applied in a frequency-variable display device which receives different driving frequencies such as a computer monitor. More specifically, in the conventional high-speed driving scheme, a voltage level of the modulated data Mdata is fixed to a specific frequency (e.g., 60 Hz) and a response time (i.e., 16.7 ms) of the liquid crystal is fixed in accordance with the specific frequency. On the other hand, a computer monitor is manufactured so that its driving frequency can be changed in the range of 50 to 80 Hz. Therefore, in order to apply the conventional high-speed driving scheme to such a computer monitor, the modulated data Mdata established in the conventional high-speed driving scheme should be modified depending on a driving frequency. This is because a voltage charged in a liquid crystal should be changed depending on a driving frequency to vary a response time of the liquid crystal. As a result, when the modulated data Mdata established based on only a specific driving frequency is applied to a monitor displaying a picture at a driving frequency different from the specific frequency, a picture is more deteriorated.

SUMMARY OF THE INVENTION

Accordingly, the present invention is directed to a method and apparatus for driving a liquid crystal display that substantially obviates one or more of problems due to limitations and disadvantages of the related art.

Another object of the present invention is to provide a method and apparatus for driving a liquid crystal display that improves a picture quality.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method of driving a liquid crystal display includes determining modulated data in accordance with one of a driving frequency and a driving frequency band having a desired frequency range, separately registering the modulated data in a plurality of look-up tables separated for any one of the driving frequency and each driving frequency band having the desired frequency range, detecting the driving frequency, and selecting one of the modulated data outputted from the plurality of look-up tables in accordance with the detected driving frequency to modulate source data.

The method further includes dividing the source data into most significant bits and least significant bits, and delaying the most significant bits.

In the method, the plurality of look-up tables compare the delayed most significant bits and non-delayed most significant bits to select one of a plurality of modulated data registered in advance in accordance with the compared result.

In another aspect of the present invention, a driving apparatus for a liquid crystal display includes a mode detector detecting a driving frequency of source data, a plurality of look-up tables having registered modulated data determined for one of a driving frequency and a driving frequency band having a desired frequency range to modulate the source data, and a switch selecting one of the modulated data from the look-up tables in accordance with the detected driving frequency and outputting the selected modulated data.

The driving apparatus further includes a frame memory delaying most significant bits of the source data for one frame period and outputting the delayed most significant bits to the plurality of look-up tables.

In the driving apparatus, each of the plurality of look-up tables compares the delayed most significant bits with non-delayed most significant bits to select modulated data corresponding to the source data.

The driving apparatus further includes a data driver applying data outputted from the switch to a liquid crystal display panel, a gate driver applying a scanning signal to the liquid crystal display panel, and a timing controller applying the source data to the plurality of look-up tables and the mode detector and controlling the data driver and the gate driver.

In a further aspect of the present invention, a liquid crystal display includes a liquid crystal display panel displaying images, a mode detector detecting a driving frequency of source data, a frame memory delaying most significant bits of the source data for one frame period and outputting the delayed most significant bits of the source data, a plurality of look-up tables having registered modulated data determined for one of the driving frequency and a driving frequency band having a desired frequency range, comparing the delayed most significant bits with non-delayed significant bits of the source data, and outputting one of the registered modulated data from each look-up table based on the compared result, and a switch selecting the one of the registered modulated data in accordance with the detected driving frequency and outputting the modulated data to the liquid crystal display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention.

In the drawings.

DETAILED DESCRIPTION OF THE ILLUSTRATED EMBODIMENTS

Reference will now be made in detail to the illustrated embodiments of the present invention, examples of which are illustrated in the accompanying drawings. Wherever possible, the same reference numbers will be used throughout the drawings to refer to the same or like parts.

A driving apparatus for a liquid crystal display (LCD) according to the present invention will be explained with reference to FIGS. 5 and 6.

Figure 1:
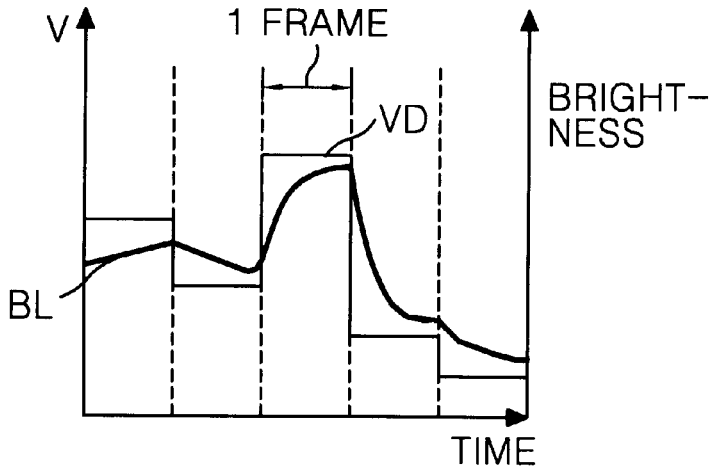
FIG. 1 CONVENTIONAL ART
FIG. 1 is a waveform diagram showing a brightness variation with respect to an applied voltage according to a conventional liquid crystal display.
Figure 2:
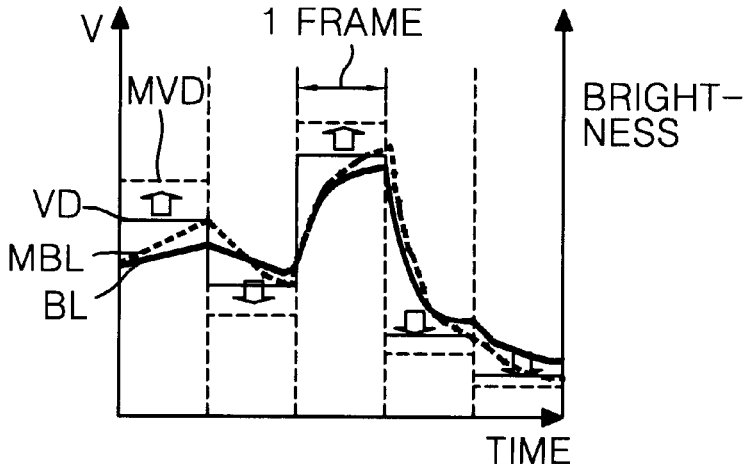
FIG. 2 CONVENTIONAL ART
FIG. 2 is a waveform diagram showing a brightness variation with respect to an applied voltage according to a conventional high-speed driving scheme.
Figure 3:
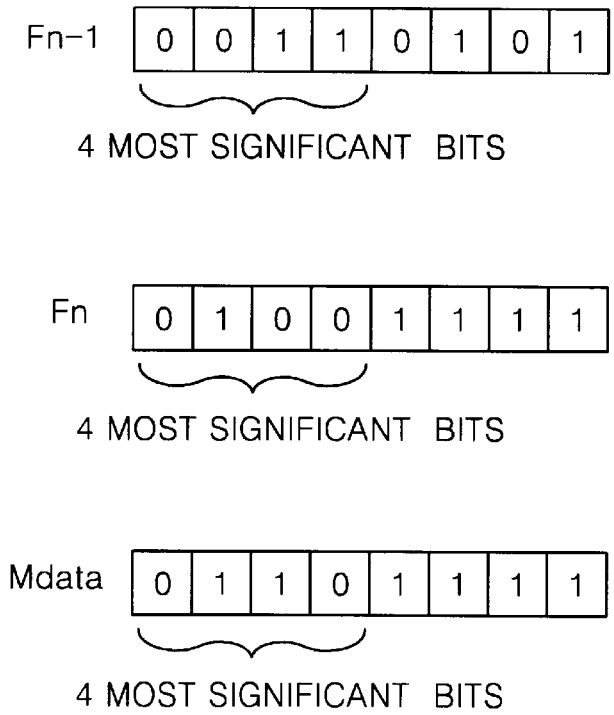
FIG. 3 CONVENTIONAL ART
FIG. 3 illustrates a conventional high-speed driving scheme applied to 8-bit data.
Figure 4:
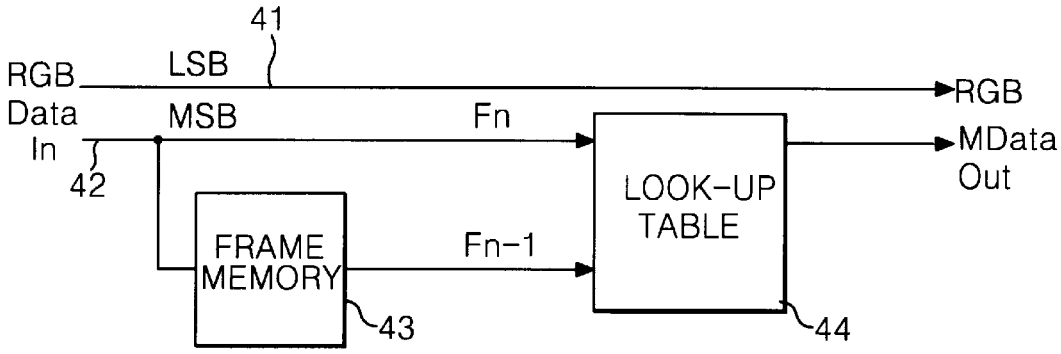
FIG. 4 CONVENTIONAL ART
FIG. 4 is a block diagram showing a configuration of a conventional high-speed driving apparatus.
Figure 5:
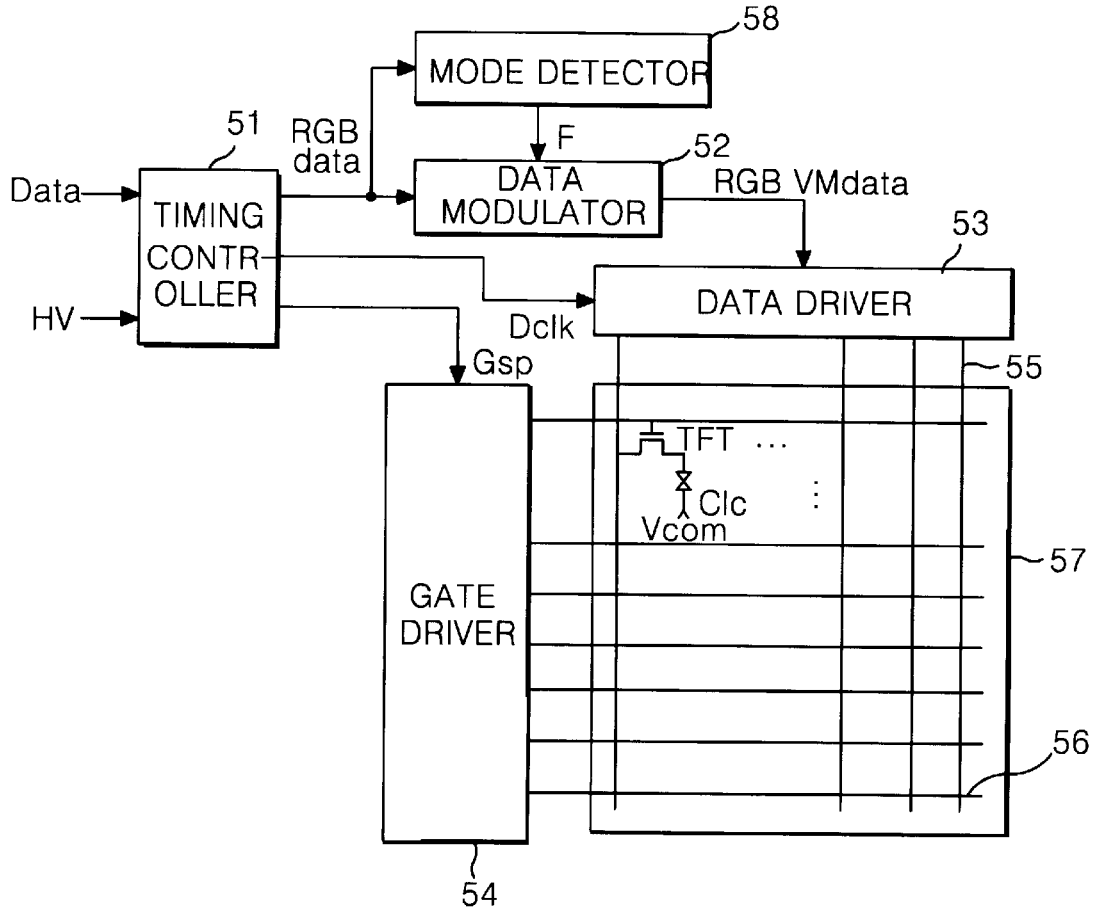
FIG. 5 is a block diagram showing a configuration of a driving apparatus for a liquid crystal display according to the present invention.

In FIG. 5, the LCD driving apparatus includes a liquid crystal display panel 57 having a plurality of data lines 55 and gate lines 56 crossing each other and having TFT's provided at the intersections therebetween to drive liquid crystal cells Clc. A data driver 53 supplies data to the data lines 55 of the liquid crystal display panel 57. A gate driver 54 applies a scanning pulse to the gate lines 56 of the liquid crystal display panel 57. A timing controller 51 receives digital video data and horizontal and vertical synchronizing signals H and V. A mode detector 58 detects a frequency of digital video data RGB. A data modulator 52 modulates the digital video data RGB using a plurality of look-up tables in which modulated data are set for each frequency or each frequency band of the digital video data RGB.

More specifically, the liquid crystal display panel 57 has a liquid crystal formed between two glass substrates, and has the data lines 55 and the gate lines 56 provided on the lower glass substrate in such a manner to perpendicularly cross each other. The TFT provided at each intersection between the data lines 55 and the gate lines 56 responds to a scanning pulse and data from the data line 55. To this end, a gate electrode of the TFT is connected to the gate line 56 while a source electrode thereof is connected to the data line 55. The drain electrode of the TFT is connected to a pixel electrode of the liquid crystal cell Clc.

The timing controller 51 rearranges digital video data supplied from a digital video card (not shown). The RGB data rearranged by the timing controller 51 are supplied to the data modulator 52 and the mode detector 58. Further, the timing controller 51 generates a plurality of timing signals, such as a dot clock Dclk, a gate start pulse GSP, a gate shift clock GSC (not shown) and an output enable/disable signal, and a polarity control signal using horizontal and vertical synchronizing signals H and V to control the data driver 53 and the gate driver 54.

The gate driver 54 includes a shift register sequentially generating a scanning pulse, that is, a gate high pulse in response to the gate start pulse GSP and the gate shift clock GSC applied from the timing controller 51, and a level shifter shifting a voltage of the scanning pulse into a level suitable for driving the liquid crystal cell Clc. The TFT is turned on in response to the scanning pulse. Upon turning on the TFT, video data through the data line 55 are applied to the pixel electrode of the liquid crystal cell Clc.

The data driver 53 is supplied with a frequency-variable data VMdata modulated by the data modulator 52 and receives a dot clock Dclk from the timing controller 51. The data driver 53 selects the variable modulated data VMdata in accordance with the dot clock Dclk and thereafter latches the data for each line. The data latched by the data driver 53 is converted into analog data to be simultaneously applied to the data lines 55 at every scanning interval. Further, the data driver 53 may apply a gamma voltage corresponding to the modulated data to the data line 55.

The data modulator 52 includes a plurality of look-up tables in which modulated data are set for each driving frequency or each of a plurality of driving frequency ranges each having a constant frequency range. The data modulator 52 selects a look-up table based on a frequency-detecting signal from the mode detector 58, and selects modulated data from the corresponding look-up table based on a difference in data between the previous frame Fn−1 and the current frame Fn.

The mode detector 58 counts digital video data RGB to detect a frequency of the digital video data RGB. Frequency information of the detected digital video data RGB is applied to a control terminal of the data modulator 52 as a frequency-detecting signal F.

Figure 6:
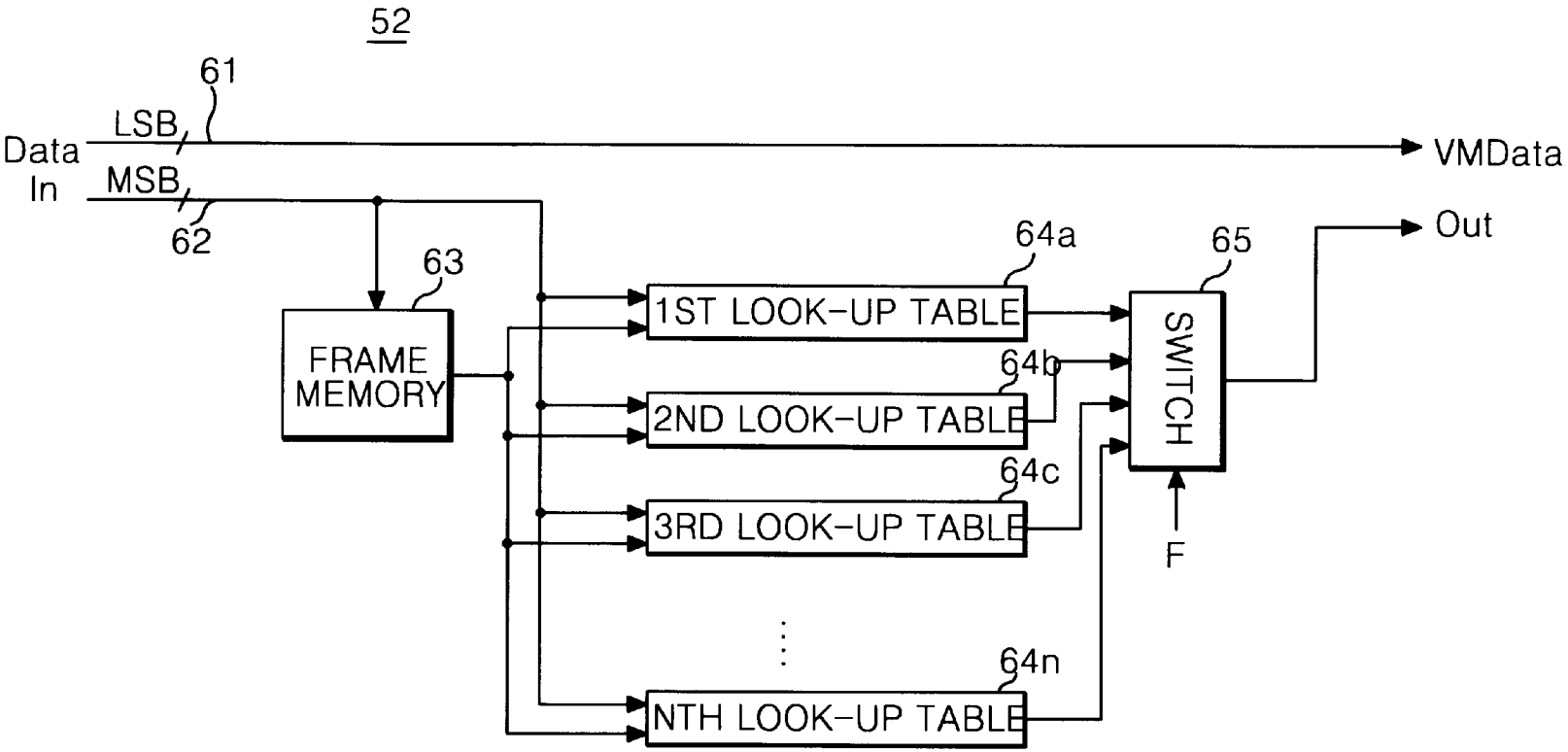
FIG. 6 is a detailed block diagram of the data modulator shown in FIG. 5.

FIG. 6 is a detailed block diagram of the data modulator 52 shown in FIG. 5.

Referring to FIG. 6, the data modulator 52 includes a frame memory 63 receiving most significant bits MSB, a plurality of look-up tables 64*a* to 64*n* in which modulated data are set for each frequency or each frequency band, and a switch 65 selecting one of the modulated data outputted from the look-up tables 64*a* to 64*n* in accordance with a driving frequency.

The frame memory 63 is connected to a most significant bit bus line 62 of the timing controller 51 to store most significant bits MSB inputted from the timing controller 51 during one frame interval. Further, the frame memory 63 applies most significant bits MSB stored in every frame to the look-up tables 64*a* to 64*n*.

Each of the look-up tables 64*a* to 64*n* is registered with modulated data independently set for each driving frequency or each frequency band. A value of the modulated data set at each look-up table 64*a* to 64*n* is determined based on a response time required for each driving frequency or each driving frequency band as given in the following table:

TABLE 3

| Driving frequency (Hz) | 50 | 60 | 70 | 80 |
|---|---|---|---|---|
| Response time of LCD(ms) | 20 | 16.7 | 14.3 | 12.5 |

As shown in the above table, a response time of the liquid crystal required in accordance with a driving frequency is inversely proportional to the driving frequency. Thus, a value of the modulated data at each of the look-up tables 64*a* to 64*n* is differently set for a driving frequency or a driving frequency band.

A value of the modulated data registered in each look-up table 64*a* to 64*n* is determined in accordance with a compared result of the previous frame Fn−1 and the current frame Fn to satisfy the following equations:

$$VDn<VDn-1 \rightarrow MVDn<VDn \quad \text{(i)}$$

$$VDn=VDn-1 \rightarrow MVDn=VDn \quad \text{(ii)}$$

$$VDn>VDn-1 \rightarrow MVDn>VDn \quad \text{(iii)}$$

In the above equations, VDn−1 represents a data voltage of the previous frame, VDn is a data voltage of the current frame, and MVDn represents a modulated data voltage.

TABLE 4

| Driving frequency band (Hz) | Look-up tables determined for driving frequency band |
|---|---|
| 50~55 | Look-up table (50 Hz) |
| 56~65 | Look-up table (60 Hz) |
| 66~75 | Look-up table (70 Hz) |
| 76~80 | Look-up table (80 Hz) |

As shown in the above Table 4, if modulated data are set for each driving frequency band having a constant frequency range, a memory size of the look-up tables may be reduced more in comparison to the case where modulated data are set for each driving frequency. This is because it is possible to set the modulated data for each frequency band as mentioned above. A small frequency variation does not almost influence a required response time of the liquid crystal.

Figure 7:
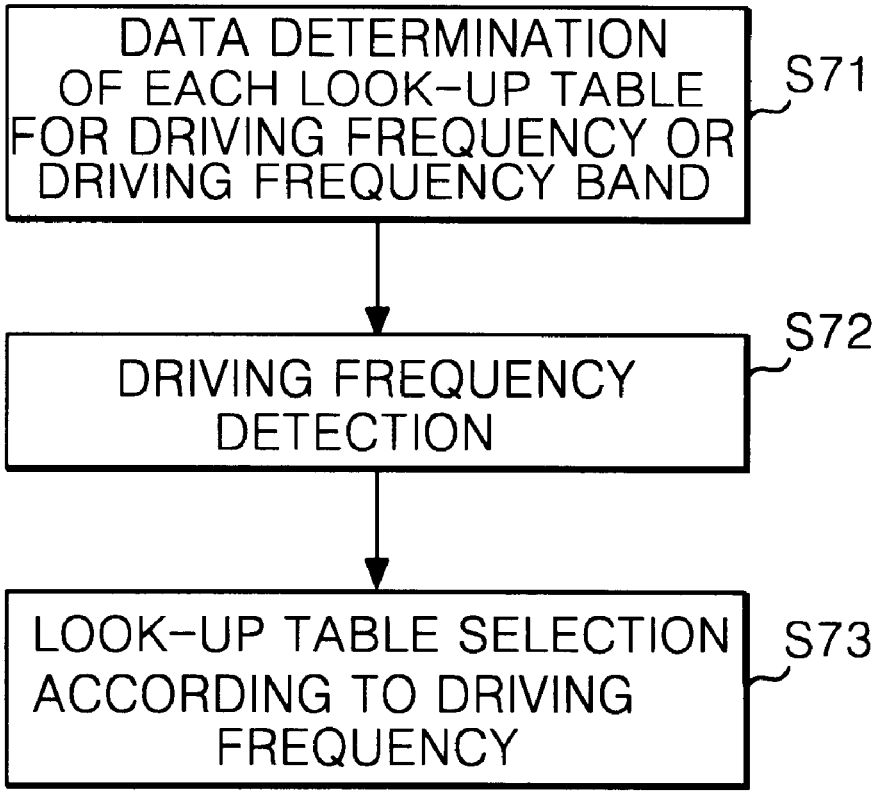
FIG. 7 is a flow chart illustrating a modulating procedure of a liquid crystal display according to the present invention.

In the LCD driving method and apparatus according to the present invention, the above-mentioned data modulating procedure may be summarized into a flow chart of FIG. 7.

Referring to FIG. 7, at step S71, modulated data having a value determined for each driving frequency or each driving frequency band with a constant frequency range are registered in each of the look-up tables 64*a* to 64*n*. Subsequently, at step S72, a driving frequency is detected by the mode detector 58. Finally, at step S73, modulated data corresponding to the detected driving frequency are selected from the modulated data selected via each look-up table 64*a* to 64*n*.

The LCD driving method and apparatus of the present invention has a scheme of modulating only most significant bits. However, source data at full bits (i.e., 8 bits) may also be modulated.

As described above, according to the present invention, the modulated data set for each driving frequency or each driving frequency band are registered in a plurality of look-up tables, thereby detecting a driving frequency of the current input data and selecting the modulated data suitable for the detected driving frequency. Optimal modulated data are selected in response to the detected driving frequency, so that a required response time of the liquid crystal can be obtained for each driving frequency. Accordingly, an optimal high-speed driving scheme can be realized for a display device which receives different driving frequencies, thereby improving a picture quality.

Alternatively, the data modulator and the operator can be implemented by other means, such as a program and a microprocessor for carrying out this program, rather than the look-up table. Also, the present invention is applicable to all other fields requiring a data modulation, such as a plasma display panel, an field emission display and an electroluminescence display, etc.

It will be apparent to those skilled in the art that various modifications and variations can be made in the method and apparatus for driving a liquid crystal display of the present invention without departing from the spirit or scope of the inventions. Thus, it is intended that the present invention covers the modifications and variations of this invention provided they come within the scope of the appended claims and their equivalents.

What is claimed is:

1. A method of driving a liquid crystal display, comprising:

determining modulated data in accordance with one of a driving frequency and a driving frequency band having a desired frequency range;

separately registering the modulated data in a plurality of look-up tables separated for any one of the driving frequency and each driving frequency band having the desired frequency range;

detecting the driving frequency; and selecting one of the modulated data outputted from the plurality of look-up tables in accordance with the detected driving frequency to modulate source data.

2. The method according to claim 1, further comprising:

dividing the source data into most significant bits and least significant bits; and delaying the most significant bits for one frame period.

3. The method according to claim 2, wherein the delayed most significant bits are compared with non-delayed most significant bits in the look-up tables to select one of the registered modulated data in accordance with the compared result.

4. A driving apparatus for a liquid crystal display, comprising:

a mode detector detecting a driving frequency of source data;

a plurality of look-up tables having registered modulated data determined for one of a driving frequency and a driving frequency band having a desired frequency range to modulate the source data; and a switch selecting one of the modulated data from the look-up tables in accordance with the detected driving frequency and outputting the selected modulated data.

5. The driving apparatus according to claim 4, further comprising a frame memory delaying most significant bits of the source data for one frame period and outputting the delayed most significant bits to the look-up tables.

6. The driving apparatus according to claim 5, wherein the delayed most significant bits are compared with non-delayed most significant bits in each look-up table to select the modulated data corresponding to the source data.

7. The driving apparatus according to claim 4, further comprising:

a data driver applying the selected modulated data to a liquid crystal display panel;

a gate driver applying a scanning signal to the liquid crystal display panel; and a timing controller applying the source data to the look-up tables and the mode detector and controlling the data driver and the gate driver.

8. A liquid crystal display comprising:

a liquid crystal display panel displaying images;

a mode detector detecting a driving frequency of source data;

a frame memory delaying most significant bits of the source data for one frame period and outputting the delayed most significant bits of the source data;

a plurality of look-up tables having registered modulated data determined for one of the driving frequency and a driving frequency band having a desired frequency range, comparing the delayed most significant bits with non-delayed significant bits of the source data, and outputting one of the registered modulated data from each look-up table based on the compared result; and a switch selecting the one of the registered modulated data in accordance with the detected driving frequency and outputting the modulated data to the liquid crystal display panel.

9. The liquid crystal display according to claim 8, further comprising:

a data driver applying the selected modulated data to a liquid crystal display panel;

a gate driver applying a scanning signal to the liquid crystal display panel; and a timing controller applying the source data to the look-up tables and the mode detector and controlling the data driver and the gate driver.

* * * * *